US011415133B2

(12) United States Patent
Ding et al.

(10) Patent No.: US 11,415,133 B2
(45) Date of Patent: Aug. 16, 2022

(54) MULTI-STAGE DRY ROOTS VACUUM PUMP

(71) Applicant: ZHONGSHAN TIANYUAN VACUUM EQUIPMENT TECHNOLOGY CO., LTD., Guangdong (CN)

(72) Inventors: Dongsheng Ding, Guangdong (CN); Weiguo Ren, Guangdong (CN); Yiwen Ma, Guangdong (CN)

(73) Assignee: ZHONGSHAN TIANYUAN VACUUM EQUIPMENT TECHNOLOGY CO., LTD, Zhongshan (CN)

( * ) Notice: Subject to any disclaimer, the term of this patent is extended or adjusted under 35 U.S.C. 154(b) by 0 days.

(21) Appl. No.: 16/945,254

(22) Filed: Jul. 31, 2020

(65) Prior Publication Data

US 2021/0054841 A1 Feb. 25, 2021

Related U.S. Application Data

(63) Continuation of application No. PCT/CN2018/118358, filed on Nov. 30, 2018.

(30) Foreign Application Priority Data

Feb. 2, 2018 (CN) ..... 201810106097.2

(51) Int. Cl.
*F04C 18/12* (2006.01)
*F04C 25/02* (2006.01)
(Continued)

(52) U.S. Cl.
CPC ..... *F04C 18/126* (2013.01); *F04C 23/001* (2013.01); *F04C 23/02* (2013.01);
(Continued)

(58) Field of Classification Search
CPC .... F04C 18/126; F04C 25/02; F04C 29/0064; F04C 29/0078; F04C 29/0085; F04C 23/003; F04C 23/001
See application file for complete search history.

(56) References Cited

U.S. PATENT DOCUMENTS 2,937,807 A * 5/1960 Lorenz ..... F04C 29/005 417/247
5,767,635 A * 6/1998 Steffens ..... F04C 29/0085 318/85

(Continued)

FOREIGN PATENT DOCUMENTS

CN 2504406 Y 8/2002
CN 101382137 A 3/2009

(Continued)

*Primary Examiner* — Mary Davis

(57) ABSTRACT

A multi-stage dry Roots vacuum pump, including a pump body, multi-stage Roots working units and a plurality of drive components. The pump body is provided with a plurality of independent working chambers, and airflow channels communicating the various working chambers; the airflow channels are communicated with outside; the Roots working units of each stage include driving Roots rotors and driven Roots rotors; the driving Roots rotors and driven Roots rotors are positioned in the working chambers; and the various drive components are respectively used for driving the driving Roots rotors and driven Roots rotors positioned in the various working chambers to rotate towards opposite directions at the same rotating speed. The Roots working units of various stages may be randomly distributed at various positions of the pump body on premise of ensuring that the airflow channels can communicate the working chambers of each stage.

9 Claims, 4 Drawing Sheets

(51) Int. Cl.

| | |
|---|---|
| ***F04C 29/00*** | (2006.01) |
| ***F04C 23/00*** | (2006.01) |
| ***F04C 23/02*** | (2006.01) |
| ***F04C 28/02*** | (2006.01) |

(52) U.S. Cl.
CPC ..... *F04C 25/02* (2013.01); *F04C 28/02* (2013.01); *F04C 29/0064* (2013.01); *F04C 29/0078* (2013.01); *F04C 2240/402* (2013.01); *F04C 2240/70* (2013.01)

(56) References Cited

U.S. PATENT DOCUMENTS

| | | | | |
|---|---|---|---|---|
| 6,056,510 | A * | 5/2000 | Miura | F04B 37/14 417/19 |
| 6,196,810 | B1 * | 3/2001 | Taniguchi | F04C 23/001 417/248 |
| 6,305,910 | B1 * | 10/2001 | Miura | F04C 23/001 417/244 |
| 7,578,665 | B2 * | 8/2009 | Tanigawa | F04C 25/02 310/103 |
| 2004/0213686 | A1 | 10/2004 | Ojima et al. | |
| 2006/0222506 | A1 * | 10/2006 | Rival | F04C 23/001 417/2 |
| 2007/0048162 | A1 | 3/2007 | Imai et al. | |
| 2012/0051948 | A1 * | 3/2012 | Dirscherl | F04C 25/02 417/66 |
| 2013/0336828 | A1 | 12/2013 | Ohta | |
| 2014/0093412 | A1 | 4/2014 | Stones et al. | |

FOREIGN PATENT DOCUMENTS

| | | | |
|---|---|---|---|
| CN | 104632629 | A | 5/2015 |
| CN | 106438365 | A | 2/2017 |
| CN | 208474109 | U | 2/2019 |
| JP | 3571985 | B2 | 9/2004 |

* cited by examiner

MULTI-STAGE DRY ROOTS VACUUM PUMP

CROSS-REFERENCE TO RELATED APPLICATIONS

This application is a continuation of International Application No. PCT/CN2018/118358, filed on Nov. 30, 2018, which claims the benefit of priority from Chinese Patent Application No. 201810106097.2, filed on Feb. 2, 2018. The content of the aforementioned applications, including any intervening amendments thereto, is incorporated herein by reference.

TECHNICAL FIELD

The present invention belongs to the technical field of Roots vacuum pumps, and particularly relates to a multi-stage dry Roots vacuum pump.

BACKGROUND OF THE PRESENT INVENTION

A multi-stage dry Roots vacuum pump in related technologies is formed by sequentially mounting all stages of driving Roots rotors on the same driving Roots rotating shaft and sequentially mounting all stages of driven Roots rotors on the same driven Roots rotating shaft. The driving Roots rotors and driven Roots rotors of each stage are in one-to-one correspondence and are partitioned by partition plates to form stage-by-stage Roots working units. However, since the driving Roots rotors and driven Roots rotors of each stage are respectively connected in series on the same driving Roots rotating shaft and the same driven Roots rotating shaft, the Roots working units of each stage cannot select different rotating speeds according to own needs, but realize different compression ratios among the Roots working units of each stage by virtue of volume changes of the Roots working units of each stage. Thus, the higher the number of stages of the dry Roots vacuum pump is, the larger the volume is. Miniaturization development of the dry Roots vacuum pump is limited.

SUMMARY OF THE PRESENT INVENTION

A purpose of the present invention is to provide a multi-stage dry Roots vacuum pump, for solving a technical problem that the multi-stage dry Roots vacuum pump goes against miniaturization development.

To achieve the above purpose, technical solutions adopted in the present invention are as follows: the multi-stage dry Roots vacuum pump includes:

a pump body, wherein the pump body is provided with a plurality of independent working chambers, and airflow channels communicating the working chambers; and the airflow channels are communicated with outside;

multi-stage Roots working units, wherein the Roots working units of each stage include driving Roots rotors and driven Roots rotors; and the driving Roots rotors and driven Roots rotors are positioned in the working chambers; and a plurality of drive components, wherein the various drive components are respectively used for driving the driving Roots rotors and driven Roots rotors positioned in the various working chambers to rotate towards opposite directions at the same rotating speed.

Optionally, the drive components include a plurality of first motors and a plurality of second motors; rotors of the first motors are connected with the driving Roots rotors and drive the driving Roots rotors to rotate; rotors of the second motors are connected with the driven Roots rotors and drive the driven Roots rotors to rotate; and the driving Roots rotors and the driven Roots rotors have the same rotating speed and opposite rotating directions.

Optionally, the Roots working units of each stage further include driving Roots rotating shafts and driven Roots rotating shafts; the rotors of the first motors are connected with one end of the driving Roots rotating shafts and drive the driving Roots rotating shafts to rotate; the other ends of the driving Roots rotating shafts are connected with the driving Roots rotors; the rotors of the second motors are connected with one end of the driven Roots rotating shafts and drive the driven Roots rotating shafts to rotate; the other ends of the driven Roots rotating shafts are connected with the driven Roots rotors.

Optionally, the drive components include a plurality of motors and a plurality of meshing components; the Roots working units of each stage further include the driving Roots rotating shafts and the driven Roots rotating shafts; the driving Roots rotating shafts are connected with the driving Roots rotors; the driven Roots rotating shafts are connected with the driven Roots rotors; the meshing components are meshed between the driving Roots rotating shafts and the driven Roots rotating shafts, and are used for driving the driving Roots rotating shafts and the driven Roots rotating shafts to rotate towards opposite directions at the same rotating speed; and rotors of the motors are connected with the driving Roots rotating shafts and drive the driving Roots rotating shafts to rotate.

Optionally, the meshing components include a pair of magnetic gears; one magnetic gear is mounted on the driving Roots rotating shafts; and the other magnetic gear is mounted on the driven Roots rotating shafts.

Optionally, the meshing components include a pair of mechanical gears meshed with each other; one mechanical gear is mounted on the driving Roots rotating shafts; and the other mechanical gear is mounted on the driven Roots rotating shafts.

Optionally, a first sealing cover is arranged between stators and rotors of the motors, and is used for isolating the stators and rotors of the motors.

Optionally, the multi-stage dry Roots vacuum pump further includes a magnetic coupling; a spindle of the motors is connected with a driving end of the magnetic coupling and drives the driving end of the magnetic coupling to rotate; and a driven end of the magnetic coupling is connected with the driving Roots rotating shafts and drives the driving Roots rotating shafts to rotate.

Optionally, the magnetic coupling includes a first disc body, a second sealing cover and a second disc body; the first disc body is connected with the rotors of the motors; the second disc body is connected with the driving Roots rotating shafts; and the second sealing cover is arranged between the first disc body and the second disc body and is used for isolating the first disc body and the second disc body.

Optionally, the pump body is provided with a first air inlet communicated with outside and a first air outlet communicated with outside; the working chambers of each stage are provided with second air inlets and second air outlets; the second air inlets and second air outlets between two adjacent working chambers are sequentially communicated in a serial way via the airflow channels; and two ends of the airflow channels are respectively communicated with the first air inlet and the first air outlet.

Optionally, the pump body is provided with a first air inlet communicated with outside and a first air outlet communicated with outside; the working chambers of each stage are provided with second air inlets and second air outlets; the second air inlets and second air outlets between partial two adjacent working chambers are sequentially communicated in a parallel way via the airflow channels, and communicated with the second air inlets and second air outlets among the rest working chambers in a serial way; and two ends of the airflow channels are respectively communicated with the first air inlet and the first air outlet.

Optionally, the multi-stage dry Roots vacuum pump further includes a drive control device; and the drive control device is electrically connected with each of the drive components and controls each of the drive components to rotate.

The multi-stage dry Roots vacuum pump provided by embodiments of the present invention has beneficial effects as follows: compared with the prior art, the multi-stage dry Roots vacuum pump in the present invention has advantages as follows: since the Roots working units positioned in the various working chambers are driven by one independent drive component, the driving Roots rotor and the driven Roots rotor of each Roots working unit have independent rotating speeds. Thus, the compression ratios of the Roots working units of each stage can be realized by volume ratios of the working chambers of each stage instead of by volume ratios of the working chambers of each stage simply, or realized by rotating speed ratios of the driving Roots rotors and driven Roots rotors among the Roots working units of each stage, or realized by a combination of the rotating speed ratios and volume ratios among the Roots working units of each stage. An optional range is wide, so that the Roots working units of each stage can be flexibly designed as needed. In this way, the volumes of the working chambers may be decreased by increasing the rotating speeds of the driving Roots rotors and the driven Roots rotors in the same compression ratio; and the volumes of the working chambers may be increased in a manner of decreasing the rotating speeds of the driving Roots rotors and the driven Roots rotors, so that the volumes of the various working chambers are uniform or approximately uniform. Therefore, geometric dimensioning of the working chambers is decreased due to a high pumping speed under a condition that the pump body has the same pumping speed, thereby achieving aims of decreasing manufacturing cost, decreasing operating energy consumption and improving conditions of an outlet end. The geometric dimension of the working chambers is increased due to a low pumping speed under the condition that the pump body has the same pumping speed, thereby improving heat dissipation of the outlet end of the pump body. Moreover, the working chambers of each stage can be randomly distributed at various positions of the pump body on premise of ensuring that the airflow channels can communicate the working chambers of each stage, i.e., the Roots working units of various stages may be randomly distributed at various positions of the pump body. Thus, the volume of the pump body can be miniaturized while realizing the Roots working units of the same order of magnitude by fully utilizing the volume of the pump body.

BRIEF DESCRIPTION OF THE DRAWINGS

To more clearly describe the technical solutions in the embodiments of the present invention, the drawings required to be used in the description of the embodiments or the prior art will be simply presented below. Apparently, the drawings in the following description are merely some embodiments of the present invention, and for those ordinary skilled in the art, other drawings can also be obtained according to these drawings without contributing creative labor.

In the figures, reference symbols.

10—pump body;

11—working chambers; 12—airflow channel; 13—first air inlet; 14—first air outlet; 111—second air inlet; 112—second air outlet;

20—Roots working unit;

21—driving Roots rotor; 22—driven Roots rotor; 23—driving Roots rotating shaft;

24—driven Roots rotating shaft;

30—drive component;

31—first motor; 3101—motor stator; 3102—motor rotor; 32—meshing component;

321—mechanical gear; 31—first sealing cover; 3301—seal.

DETAILED DESCRIPTION OF THE PRESENT INVENTION

Embodiments of the present invention will be described in detail below. Examples of the embodiments are illustrated in drawings. Identical or similar symbols always represent identical or similar elements or elements having identical or similar functions. Embodiments described with reference to FIGS. 1-4 below are illustrative, are intended to explain the present invention, and shall not be understood as a limitation to the present invention.

It should be understood in the description of the present invention that terms such as "length", "width", "upper", "lower", "front", "rear", "left", "right", "vertical", "horizontal", "top", "bottom", "inner", "outer", etc. indicate direction or position relationships shown based on the drawings, and are only intended to facilitate the description of the present invention and simplify the description rather than to indicate or imply that the indicated device or element must have a specific direction or constructed and operated in a specific direction, and therefore, shall not be understood as a limitation to the present invention.

In addition, the terms such as "first" and "second" are only used for the purpose of description, rather than being understood to indicate or imply relative importance or hint the number of indicated technical features. Thus, the feature limited by "first" and "second" can explicitly or impliedly include one or more features. In the explanation of the present invention, the meaning of "a plurality of" is two or more unless otherwise clearly specified.

In the present invention, unless otherwise specifically regulated and defined, terms such as "installation", "connected", "connecting", "fixation" and the like shall be understood in broad sense, and for example, may refer to fixed connection or detachable connection or integral connection, may refer to mechanical connection or electrical connection, and may refer to direct connection or indirect connection through an intermediate medium or inner communication of two elements or interaction relationship of two elements. For those ordinary skilled in the art, the specific meanings of the above terms in the present invention may be understood according to concrete conditions.

Figure 1:
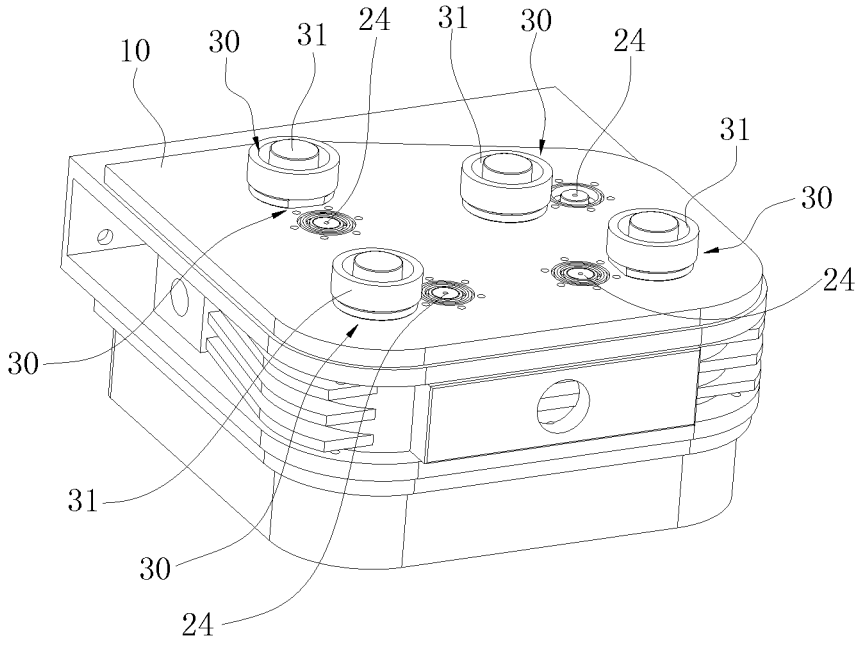
FIG. 1 is a structural schematic diagram of a multi-stage dry Roots vacuum pump provided by some embodiments of the present invention.
Figure 2:
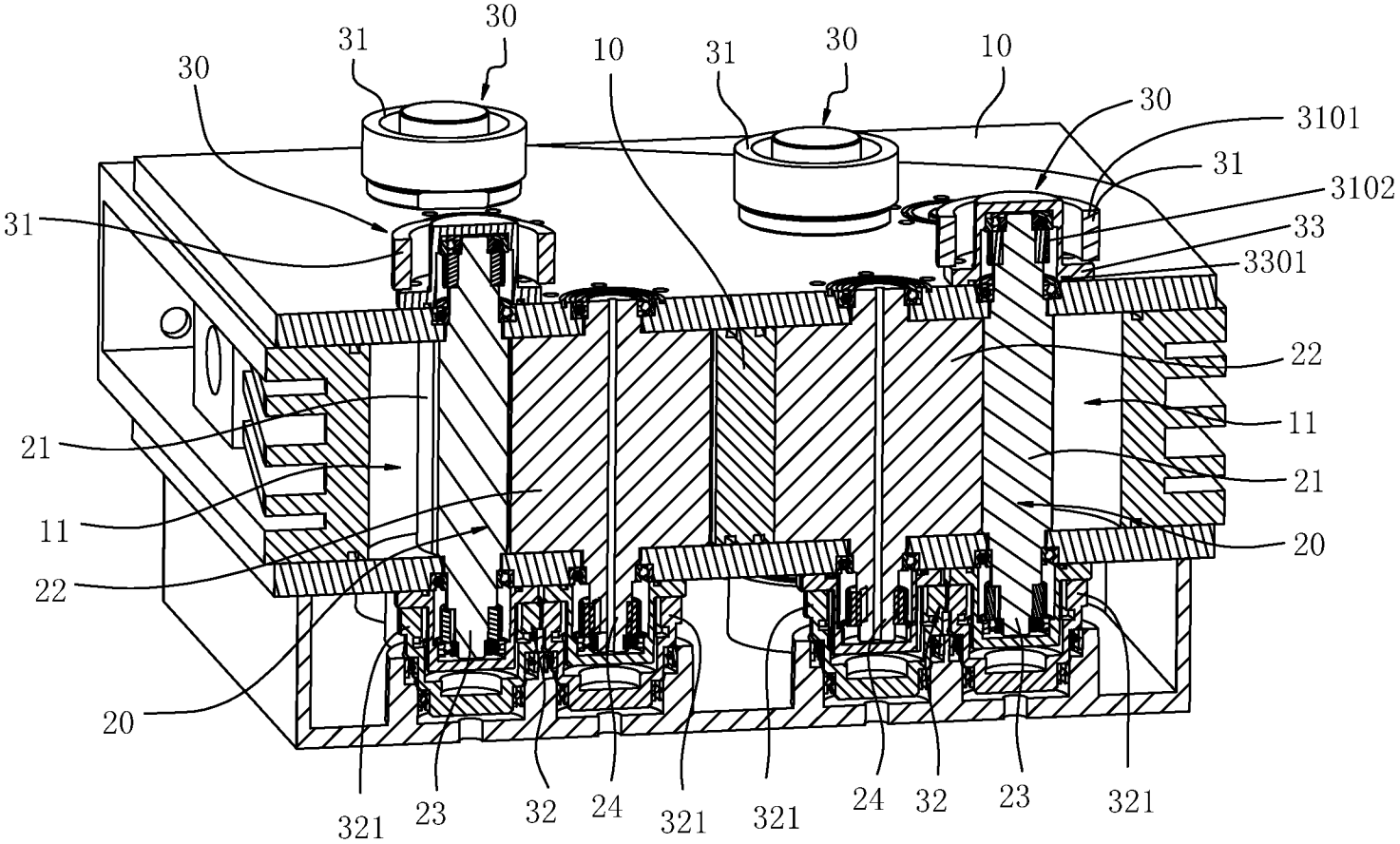
FIG. 2 is an exploded structural schematic diagram of the multi-stage dry Roots vacuum pump in FIG. 1.
Figure 4:
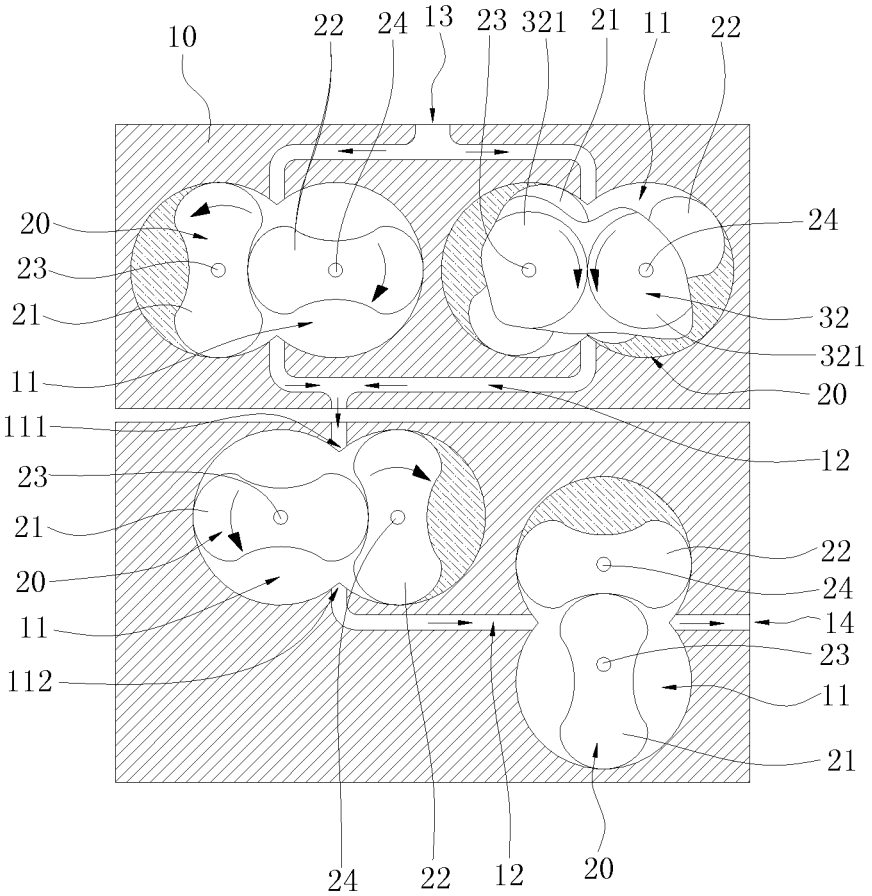
FIG. 4 is an operating principle diagram of a multi-stage dry Roots vacuum pump provided by some embodiments of the present invention.

As shown in FIGS. 1, 2 and 4, a multi-stage dry Roots vacuum pump provided by the embodiments of the present invention is described. The multi-stage dry Roots vacuum pump includes a pump body 10, multi-stage Roots working units 20 and a plurality of drive components 30, and is specifically as follows:

The pump body 10 is provided with a plurality of independent working chambers 11, and airflow channels 12 communicating the various working chambers 11; and the airflow channels 12 are communicated with outside.

The Roots working units 20 of each stage include driving Roots rotors 21 and driven Roots rotors 22; and the driving Roots rotors 21 and driven Roots rotors 22 are positioned in the working chambers 11.

The various drive components 30 are respectively used for driving the driving Roots rotors 21 and driven Roots rotors 22 positioned in the various working chambers 11 to rotate towards opposite directions at the same rotating speed.

According to the multi-stage dry Roots vacuum pump provided by the embodiments of the present invention, since the Roots working units 20 positioned in the various working chambers 11 are driven by one independent drive component 30, the driving Roots rotor 21 and the driven Roots rotor 22 of each Roots working unit 20 have independent rotating speeds. Thus, the compression ratios of the Roots working units 20 of each stage can be realized by volume ratios of the working chambers 11 of each stage instead of by volume ratios of the working chambers 11 of each stage simply, or realized by rotating speed ratios of the driving Roots rotors 21 and driven Roots rotors 22 among the Roots working units 20 of each stage, or realized by a combination of the rotating speed ratios and volume ratios among the Roots working units 20 of each stage. An optional range is wide, so that the Roots working units 20 of each stage can be flexibly designed as needed. In this way, the volumes of the working chambers 11 may be decreased by increasing the rotating speeds of the driving Roots rotors 21 and the driven Roots rotors 22 under the same compression ratio; and the volumes of the working chambers 11 may be increased in a manner of decreasing the rotating speeds of the driving Roots rotors 21 and the driven Roots rotors 22, so that the volumes of the various working chambers 11 are uniform or approximately uniform. Therefore, the geometric dimension of the working chambers 11 is decreased due to a high pumping speed under a condition that the pump body 10 has the same pumping speed, thereby achieving aims of decreasing manufacturing cost, decreasing operating energy consumption and improving conditions of an outlet end. The geometric dimension of the working chambers 11 is increased due to a low pumping speed under the condition that the pump body 10 has the same pumping speed, thereby improving heat dissipation of the outlet end of the pump body 10. Moreover, the working chambers 11 of each stage can be randomly distributed at various positions of the pump body 10 on premise of ensuring that the airflow channels 12 can communicate the working chambers of 11 each stage, i.e., the Roots working units 20 of various stages may be randomly distributed at various positions of the pump body 10. Thus, the pump body 10 can be miniaturized more while realizing the same order of magnitude of the Roots working units 20 by fully utilizing the volume of the pump body 10.

In another embodiment of the present invention, the drive components 30 include a plurality of first motors 31 and a plurality of second motors; rotors of the first motors 31 are connected with the driving Roots rotors and drive the driving Roots rotors to rotate; rotors of the second motors are connected with the driven Roots rotors and drive the driven Roots rotors to rotate; and the driving Roots rotors and the driven Roots rotors have the same rotating speed and opposite rotating directions. Specifically, when the driving Roots rotors and driven Roots rotors of the Roots working units of each stage are driven to rotate, the driving Roots rotors are driven by the first motors 31 to rotate, and the driven Roots rotors are driven by the second motors to rotate, i.e., the driving Roots rotors and the driven Roots rotors are respectively driven by one drive component. By controlling the rotating speeds and rotation directions of the first motors 31 and the second motors, meshing mechanisms arranged between the driving Roots rotors and the driven Roots rotors can be avoided. Similarly, the driving Roots rotors and the driven Roots rotors in each of the working chambers can rotate towards opposite directions at the same rotating speed, and a service effect is excellent. Moreover, since the rotors of the first motors 31 are directly connected with the driving Roots rotors and the rotors of the second motors are directly connected with the driven Roots rotors, a coupling does not need to be arranged between the rotors of the first motors 31 and the driving Roots rotors, and a coupling does not need to be arranged between the rotors of the second motors and the driven Roots rotors. Thus, the structure of the pump body may be simpler; the size can be further decreased; the cost may be further reduced; and reliability may be further increased.

In another embodiment of the present invention, the Roots working units 20 of each stage further include driving Roots rotating shafts and driven Roots rotating shafts; the rotors of the first motors 31 are connected with one end of the driving Roots rotating shafts and drive the driving Roots rotating shafts to rotate; the other ends of the driving Roots rotating shafts are connected with the driving Roots rotors; the rotors of the second motors are connected with one end of the driven Roots rotating shafts and drive the driven Roots rotating shafts to rotate; the other ends of the driven Roots rotating shafts are connected with the driven Roots rotors. Specifically, by arranging the driving Roots rotating shafts between the first motors 31 and the driving Roots rotors, the first motors 31 can drive the driving Roots rotors to rotate by virtue of transmission of the driving Roots rotating shafts, and then mounting positions of the first motors 31 can be adjusted according to needs, thereby reasonably utilizing the space of the pump body. By arranging the driven Roots rotating shafts between the second motors and the driven Roots rotors, the second motors can drive the driven Roots rotors to rotate by virtue of transmission of the driven Roots rotating shafts, and then mounting positions of the second motors can be adjusted according to needs, thereby reasonably utilizing the space of the pump body. Since the driving Roots rotors and the driven Roots rotors are directly respectively driven by the first motors 31 and the second motors, the meshing mechanisms do not need to be arranged between the driving Roots rotating shafts and the driven Roots rotating shafts. Therefore, the driving Roots rotors and the driven Roots rotors can rotate at the same fixed rotating speed and in opposite rotation directions; the structure is simpler; lubrication is not needed; and noise is effectively eliminated.

Figure 3:
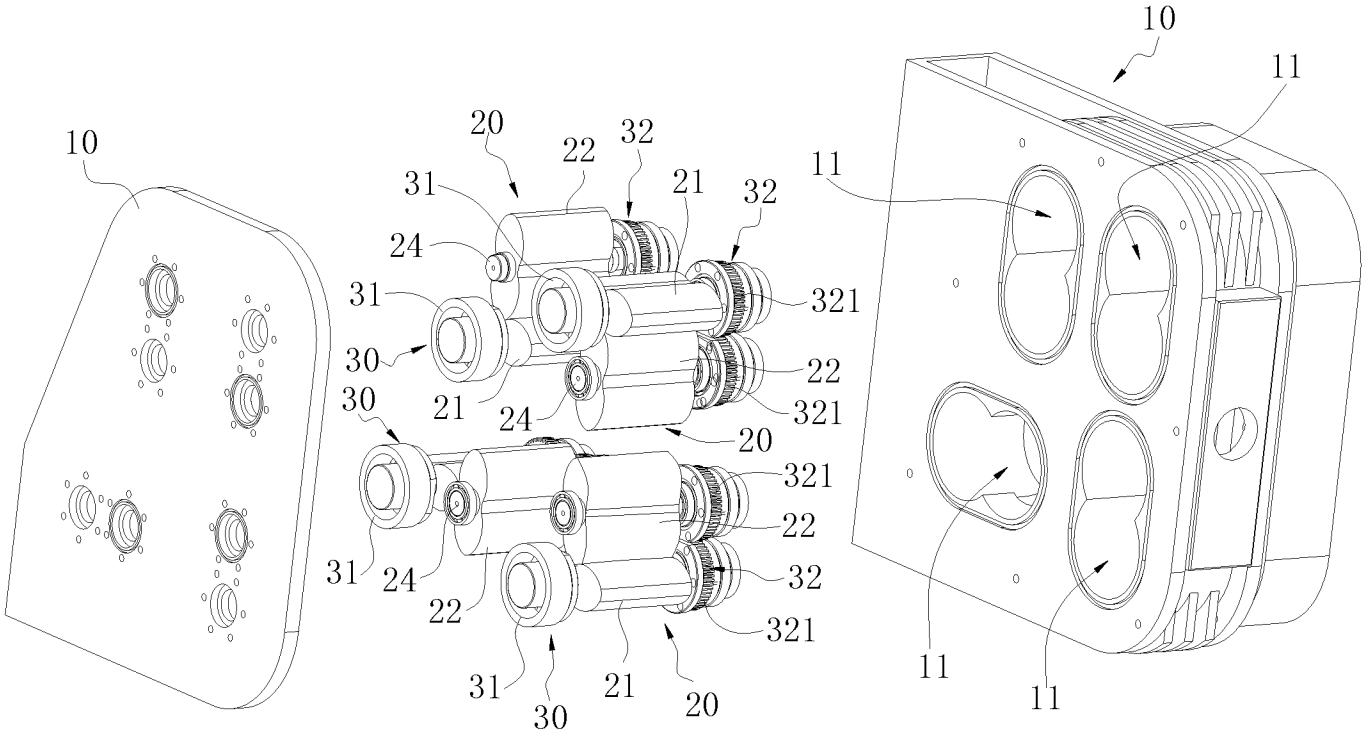
FIG. 3 is a structural schematic diagram of a section of the multi-stage dry Roots vacuum pump in FIG. 1.

In another embodiment of the present invention, as shown in FIGS. 2 and 3, the drive components 30 include a plurality of first motors 31 and a plurality of meshing components 32; the Roots working units 20 of each stage further include driving Roots rotating shafts 23 and driven Roots rotating shafts 24; the driving Roots rotating shafts 23 are connected with the driving Roots rotors 21; the driven Roots rotating shafts 24 are connected with the driven Roots rotors 22; the meshing components 32 are meshed between the driving Roots rotating shafts 23 and the driven Roots rotating shafts 24, and are used for driving the driving Roots rotating shafts 23 and the driven Roots rotating shafts 24 to rotate towards opposite directions at the same rotating speed; and rotors of the first motors 31 are connected with the driving Roots rotating shafts 23 and drive the driving Roots rotating shafts 23 to rotate. Specifically, by arranging the meshing components 32 between the driving Roots rotating shafts 23 and the driven Roots rotating shafts 24 of the Roots working units 20 of each stage, when the first motors 31 drive the driving Roots rotating shafts 23 to rotate, the driving Roots rotors 21 and the driven Roots rotors 22 of the Roots working units 20 of each stage can rotate towards opposite directions at the same rotating speed; and a fixed rotating relationship can be maintained between the driving Roots rotors 21 and the driven Roots rotors 22. Moreover, since rotors of the first motors 31 are directly connected with the driving Roots rotors 21, a coupling does not need to be arranged between the rotors of the first motors 31 and the driving Roots rotors 21 for transmission. Therefore, the structure of the pump body 10 may be simpler; the size can be further decreased; the cost may be further reduced; and reliability may be further increased.

In another embodiment of the present invention, the meshing components 32 include a pair of magnetic gears; one magnetic gear is mounted on the driving Roots rotating shafts 23; and the other magnetic gear is mounted on the driven Roots rotating shafts 24. Specifically, by arranging the pair of magnetic gears between the driving Roots rotating shafts 23 and the driven Roots rotating shafts 24, the driving Roots rotating shafts 23 and the driven Roots rotating shafts 24 can rotate towards opposite directions at the same rotating speed. Since gear meshing in magnetic transmission is adopted between the Roots rotating shafts 23 and the driven Roots rotating shafts 24, mechanical contact is avoided during meshing of the Roots rotating shafts 23 and the driven Roots rotating shafts 24, lubrication is not needed, and noise is avoided. Moreover, the requirement on transmission accuracy between the magnetic gear on the driving Roots rotating shafts 23 and the magnetic gear on the driven Roots rotating shafts 24 is reduced; transmission impact is decreased; and the service effect is excellent.

In another embodiment of the present invention, as shown in FIGS. 2 and 3, the meshing components 32 include a pair of mechanical gears 321 meshed with each other; one mechanical gear 321 is mounted on the driving Roots rotating shafts; and the other mechanical gear 321 is mounted on the driven Roots rotating shafts. Specifically, by arranging the pair of mechanical gears 321 between the driving Roots rotating shafts and the driven Roots rotating shafts, the driving Roots rotating shafts and the driven Roots rotating shafts can rotate towards opposite directions at the same rotating speed, thereby maintaining stability of the rotating relationship between the driving Roots rotating shafts and the driven Roots rotating shafts.

In another embodiment of the present invention, a first sealing cover 33 is arranged between stators 3101 and rotors 3102 of the first motors 31, and is used for isolating the stators 3101 and rotors 3102 of the first motors 31. Specifically, by arranging the first sealing cover 33 between the stators 3101 and rotors 3102 of the first motors 31, a magnetic field between the stators 3101 and rotors 3102 of the first motors 31 is not influenced by the first sealing cover, i.e., magnetic transmission between the stators 3101 and rotors 3102 of the first motors 31 is not influenced. The driving Roots rotors 21 and the driven Roots rotors 22 are isolated from the outside by the first sealing cover 33, so that dynamic seal 3301 is changed into static seal. Therefore, sealing properties and service life of the Roots working units 20 are improved.

In another embodiment of the present invention, the multi-stage dry Roots vacuum pump further includes a magnetic coupling; a spindle of the first motors 31 is connected with a driving end of the magnetic coupling and drives the driving end of the magnetic coupling to rotate; and a driven end of the magnetic coupling is connected with the driving Roots rotating shafts 23 and drives the driving Roots rotating shafts 23 to rotate. Specifically, by arranging the magnetic coupling between the first motors 31 and the driving Roots rotating shafts 23 for transmission, electromagnetic flexible transmission is formed between the first motors 31 and the driving Roots rotating shafts 23. Thus, the requirement on transmission accuracy between the first motors 31 and the driving Roots rotating shafts 23 can be reduced, thereby decreasing cost during installation or manufacture. Moreover, transmission impact between the first motors 31 and the driving Roots rotating shafts 23 is decreased, thereby effectively eliminating the noise and achieving an excellent service effect.

In another embodiment of the present invention, the magnetic coupling includes a first disc body, a second sealing cover and a second disc body; the first disc body is connected with the rotors 3102 of the first motors 31; the second disc body is connected with the driving Roots rotating shafts 23; and the second sealing cover is arranged between the first disc body and the second disc body and is used for isolating the first disc body and the second disc body. Specifically, by arranging the second sealing cover is arranged between the first disc body and the second disc body of the magnetic coupling, a magnetic field between the first disc body and the second disc body of the magnetic coupling is not influenced by the second sealing cover, i.e., magnetic transmission between the first disc body and the second disc body of the magnetic coupling is not influenced. The driving Roots rotors 21 and the driven Roots rotors 22 are isolated from the outside by the second sealing cover, so that dynamic seal is changed into static seal. Therefore, the sealing properties and service life of the Roots working units 20 are improved.

In another embodiment of the present invention, as shown in FIG. 4, the pump body 10 is provided with a first air inlet 13 communicated with outside and a first air outlet 14 communicated with outside; the working chambers 11 of each stage are provided with second air inlets 111 and second air outlets 112; the second air inlets 111 and second air outlets 112 between two adjacent working chambers 11 are sequentially communicated in a serial way via the airflow channels 12; and two ends of the airflow channels 12 are respectively communicated with the first air inlet 13 and the first air outlet 14. Specifically, the second air inlets 111 and second air outlets 112 between the working chambers 11 of each stage are sequentially connected in series via the airflow channels 12 along a gas compression direction; and the two ends of the airflow channels 12 are respectively connected with the first air inlet 13 and the first air outlet 14. Thus, a smooth gas flow channel may be formed among the various working chambers 11 positioned in the pump body 10, so as to meet compression requirements of gases in the various working chambers 11. Moreover, the airflow channels 12 can be in optional curve arrangement while ensuring smoothness. Then, the various working chambers 11 can be randomly arranged in the pump body 10 according to use needs and design and manufacture convenience. The first air outlet 14 can be directly communicated with atmosphere, so that the multi-stage dry Roots vacuum pump in the embodiments of the present invention may be a Roots pump communicated with the atmosphere.

In another embodiment of the present invention, as shown in FIG. 4, the pump body 10 is provided with a first air inlet 13 communicated with outside and a first air outlet 14 communicated with outside; the working chambers 11 of each stage are provided with second air inlets 111 and second air outlets 112; the second air inlets 111 and second air outlets 112 between partial two adjacent working chambers 11 are sequentially communicated in a parallel way via the airflow channels 12, and communicated with the second air inlets 111 and second air outlets 112 among the rest working chambers 11 in a serial way; and two ends of the airflow channels 12 are respectively communicated with the first air inlet 13 and the first air outlet 14. Specifically, the second air inlets 111 and second air outlets 112 among the rest working chambers 11 are sequentially connected in a serial or parallel way via the airflow channels 12 along the gas compression direction, while the two ends of the airflow channels 12 are respectively communicated with the first air inlet 13 and the first air outlet 14. Thus, a smooth gas flow channel may be formed among the various working chambers 11 positioned in the pump body 10, so as to meet compression requirements of the gases in the various working chambers 11. Similarly, the airflow channels 12 can be in optional curve arrangement while ensuring smoothness. Then, the various working chambers 11 can be randomly arranged in the pump body 10 according to use needs and design and manufacture convenience.

In another embodiment of the present invention, the multi-stage dry Roots vacuum pump further includes a drive control device; and the drive control device is electrically connected with each of the drive components 30 and controls each of the drive components 30 to rotate. Specifically, by performing integrated control on the various drive components 30 by the drive control device, each of the drive components 30 starts, operates and shuts down according to strict requirements. Namely, during start, the drive components 30 of each stage simultaneously start and gradually accelerate according to respective allowed loads and working conditions until a normal operating state is reached; during operation, the drive components 30 of each stage operate at a speed required by a pumping speed specified by the strict compression relation and are automatically regulated according to changes of loads; and during shutdown, the pump body 10 itself and the attached master machine are shut down in the safest, most energy-saving and most environment-friendly manner according to the lowest electric network pollution, and the service effect is excellent.

The above only describes preferred embodiments of the present invention, rather than limits the present invention. Any modification, equivalent replacement and improvement made within the spirit and principle of the present invention shall be included in the protection scope of the present invention.

We claim:

1. A multi-stage dry Roots vacuum pump, comprising:

a pump body, wherein the pump body is provided with a plurality of independent working chambers; a plurality of airflow channels communicate with the plurality of independent working chambers; and at least one of the plurality of airflow channels communicates with the outside to allow air to exit and at least one of the plurality of airflow channels communicates with the outside to allow air to enter the multi-stage Roots vacuum pump;

multi-stage Roots working units, wherein the Roots working units of each stage comprise a driving Roots rotor and a driven Roots rotor; and the respective driving Roots rotor and driven Root rotors are positioned in a respective working chamber of the plurality of independent working chambers; and a plurality of drive systems, wherein each drive system of the plurality of drive systems is respectively used for driving a respective stage and rotating the driving Roots rotor and the driven Roots rotor in their respective working chamber to rotate towards opposite directions at the same rotating speed;

each drive system comprises:

a first motor; a rotor of the first motor is connected with the driving Roots rotor and drives the driving Roots rotor to rotate;

a first sealing cover is arranged between a stator and the rotor of the first motor, and is used for sealing the driving Roots rotor.

2. The multi-stage dry Roots vacuum pump according to claim 1, wherein each of the drive systems in the plurality of drive systems further comprises a second motor; a rotor of the second motor is connected with the driven Roots rotor and drives the driven Roots rotor to rotate; and the driving Roots rotor and the driven Roots rotor have the same rotating speed and opposite rotating directions.

3. The multi-stage dry Roots vacuum pump according to claim 2, wherein the Roots working units of each stage further comprise: a driving Roots rotating shaft and a driven Roots rotating shaft; the rotor of the first motor is connected with one end of the driving Roots rotating shaft and drive the driving Roots rotating shaft to rotate; the other end of the driving Roots rotating shaft is connected with the driving Roots rotor; the rotor of the second motor is connected with one end of the driven Roots rotating shaft and drive the driven Roots rotating shaft to rotate; the other end of the driven Roots rotating shaft is connected with the driven Roots rotor.

4. The multi-stage dry Roots vacuum pump according to claim 1, wherein the drive system comprises a plurality of meshing components; the Roots working unit of each stage further comprise a driving Roots rotating shaft and a driven Roots rotating shaft; the driving Roots rotating shaft is connected with the driving Roots rotor; the driven Roots rotating shaft is connected with the driven Roots rotor; the meshing components are meshed between the driving Roots rotating shaft and the driven Roots rotating shaft, and the meshing components are used for driving the driving Roots rotating shaft and the driven Roots rotating shaft to rotate towards opposite directions at the same rotating speed.

5. The multi-stage dry Roots vacuum pump according to claim 4, wherein the meshing components comprise a pair of magnetic gears; one magnetic gear of the pair of magnetic gears is mounted on the driving Roots rotating shaft; and the other magnetic gear of the pair of magnetic gears is mounted on the driven Roots rotating shaft.

6. The multi-stage dry Roots vacuum pump according to claim 4, wherein the meshing components comprise a pair of mechanical gears meshed with each other; one mechanical gear of the pair of mechanical gears is mounted on the driving Roots rotating shaft; and the other mechanical gear of the pair of mechanical gears is mounted on the driven Roots rotating shaft.

7. The multi-stage dry Roots vacuum pump according to claim 1, wherein the pump body is provided with a first air inlet communicated with outside and a first air outlet communicated with outside; the working chamber of each stage is provided with a second air inlet and a second air outlet; the second air inlets and the second air outlets between two adjacent working chambers are sequentially communicated in a serial way via the airflow channels; and two of the ends of the airflow channels are respectively communicated with the first air inlet and the first air outlet.

8. The multi-stage dry Roots vacuum pump according to claim 1, wherein the pump body is provided with a first air inlet communicated with outside and a first air outlet communicated with outside; the working chamber of each stage is provided with a second air inlet and a second air outlet; the second air inlet or the second air outlet between at least one of the adjacent working chambers are sequentially communicated in a parallel way via the airflow channels, and communicated with the second air inlets and the second air outlets among the remaining working chambers in a serial way; and two of the ends of the airflow channels are respectively communicated with the first air inlet and the first air outlet.

9. The multi-stage dry Roots vacuum pump according to claim 1, wherein the multi-stage dry Roots vacuum pump further comprises a drive control device; and the drive control device is electrically connected with each of the drive systems and controls each of the drive systems to rotate.

* * * * *